US011298941B2

(12) United States Patent
Degraeve et al.

(10) Patent No.: US 11,298,941 B2
(45) Date of Patent: Apr. 12, 2022

(54) DROPLET EJECTION HEAD AND MANIFOLD COMPONENT THEREFOR

(71) Applicant: Xaar Technology Limited, Cambridge (GB)

(72) Inventors: Sebastien Roger Gabriel Degraeve, Cambridge (GB); Gareth Paul Neal, Cambridge (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 17/263,508

(22) PCT Filed: Jul. 26, 2019

(86) PCT No.: PCT/GB2019/052107
§ 371 (c)(1),
(2) Date: Jan. 26, 2021

(87) PCT Pub. No.: WO2020/021285
PCT Pub. Date: Jan. 30, 2020

(65) Prior Publication Data

US 2021/0237443 A1 Aug. 5, 2021

(30) Foreign Application Priority Data

Jul. 27, 2018 (GB) ..... 1812273

(51) Int. Cl.
*B41J 2/14* (2006.01)
*B41J 2/175* (2006.01)

(52) U.S. Cl.
CPC ..... *B41J 2/14145* (2013.01); *B41J 2/175* (2013.01); *B41J 2002/14419* (2013.01); *B41J 2202/12* (2013.01)

(58) Field of Classification Search
CPC .... B41J 2/14201; B41J 2/14145; B41J 2/175; B41J 2202/12; B41J 2002/1441
See application file for complete search history.

(56) References Cited

U.S. PATENT DOCUMENTS 5,455,615 A 3/1995 Burr et al.
6,003,986 A 12/1999 Keefe
(Continued)

FOREIGN PATENT DOCUMENTS

JP H09262980 A 10/1997
JP H11320877 A 11/1999
(Continued)

OTHER PUBLICATIONS

Search Report dated Jan. 28, 2019, in the corresponding United Kingdom Application No. 1812273.9 (6 pgs.).
(Continued)

*Primary Examiner* — An H Do
(74) *Attorney, Agent, or Firm* — Eric J. Sosenko; Jonathan P. O'Brien; Honigman LLP

(57) ABSTRACT

A manifold component for a droplet ejection head, the manifold component comprising: a mount for receiving at least one actuator component that provides one or more rows of fluid chambers, each chamber being provided with at least one respective actuating element and at least one respective nozzle, each at least one actuating element being actuable to eject a droplet of fluid in said ejection direction through the corresponding at least one of said nozzles, each row extending in a row direction; an inlet manifold chamber, which extends from a first end to a second end, the second end providing fluidic connection, in parallel, to at least a group of chambers within said one or more rows of fluid chambers and being located adjacent said mount; at least one inlet port, each inlet port opening into the inlet manifold chamber at the first end thereof; and a plurality of fluid guides disposed
(Continued)

within the inlet manifold chamber, each fluid guide extending from a respective first end to a respective second end, the first ends of at least some of said fluid guides being located adjacent the first end of the inlet manifold chamber, and the second ends of at least some of said fluid guides being located adjacent the second end of the inlet manifold chamber; wherein the fluid guides diverge as they progress from the first end towards the second end of the inlet manifold chamber, the fluid guides thereby causing fluid flowing from the first end to the second end of the inlet manifold chamber to be distributed over the width, in the row direction, of the second end thereof.

20 Claims, 15 Drawing Sheets

(56) References Cited

U.S. PATENT DOCUMENTS

| | | | | |
|---|---|---|---|---|
| 6,132,033 | A | 10/2000 | Browning et al. | |
| 6,132,034 | A | 10/2000 | Miller | |
| 6,193,356 | B1 | 2/2001 | Takata | |
| 6,247,782 | B1 | 6/2001 | Takata | |
| 6,742,883 | B1 | 6/2004 | Takata | |
| 7,380,922 | B2 * | 6/2008 | Sakurai | B41J 2/175 347/84 |
| 7,387,376 | B2 * | 6/2008 | Murakami | B41J 2/17596 347/84 |
| 10,479,076 | B2 * | 11/2019 | Kanaris | B41J 2/175 |
| 2008/0231660 | A1 | 9/2008 | Brown et al. | |
| 2008/0231661 | A1 | 9/2008 | Brown et al. | |
| 2016/0200104 | A1 | 7/2016 | Nakahata | |
| 2016/0339697 | A1 * | 11/2016 | Inada | B41J 2/175 |
| 2021/0291522 | A1 * | 9/2021 | Degraeve | B41J 2/14201 |

FOREIGN PATENT DOCUMENTS

| | | | |
|---|---|---|---|
| JP | 2008201024 | A | 9/2008 |
| JP | 2018069675 | A | 5/2018 |
| WO | 2010/103937 | A1 | 9/2010 |

OTHER PUBLICATIONS

International Search Report dated Oct. 7, 2019, in International Application No. PCT/GB2019/052107 (10 pgs.).

* cited by examiner

DROPLET EJECTION HEAD AND MANIFOLD COMPONENT THEREFOR

CROSS REFERENCE TO RELATED APPLICATIONS

This application is a national stage entry of international application no. PCT/GB2019/052107, filed Jul. 26, 2019, which is based on and claims the benefit of foreign priority under 35 U.S.C. 119 to GB 1812273.9, filed Jul. 27, 2018. This entire contents of the above-referenced applications are herein expressly incorporated by reference.

The present invention relates to a manifold component for a droplet ejection head. It may find particularly beneficial application in a printhead, such as an inkjet printhead.

Droplet ejection heads are now in widespread usage, whether in more traditional applications, such as inkjet printing, or in 3D printing, or other rapid prototyping techniques.

Recently, inkjet printheads have been developed that are capable of depositing ink directly onto ceramic tiles, with high reliability and throughput. This allows the patterns on the tiles to be customized to a customer's exact specifications, as well as reducing the need for a full range of tiles to be kept in stock.

In other applications, droplet ejection heads may be used to form elements such as colour filters in LCD or OLED displays used in flat-screen television manufacturing.

Droplet ejection heads and their components continue to evolve and specialise so as to be suitable for new and/or increasingly challenging applications.

SUMMARY

Aspects of the invention are set out in the appended independent claims, while particular embodiments of the invention are set out in the appended dependent claims.

The following disclosure describes, in one aspect, a manifold component for a droplet ejection head, the manifold component comprising:

a mount for receiving at least one actuator component that provides one or more rows of fluid chambers, each chamber being provided with at least one respective actuating element and at least one respective nozzle, each at least one actuating element being actuable to eject a droplet of fluid in said ejection direction through the corresponding at least one of said nozzles, each row extending in a row direction;

an inlet manifold chamber, which extends from a first end to a second end, the second end providing fluidic connection, in parallel, to at least a group of chambers within said one or more rows of fluid chambers and being located adjacent said mount;

at least one inlet port, each inlet port opening into the inlet manifold chamber at the first end thereof; and a plurality of fluid guides disposed within the inlet manifold chamber, each fluid guide extending from a respective first end to a respective second end, the first ends of at least some of said fluid guides being located adjacent the first end of the inlet manifold chamber, and the second ends of at least some of said fluid guides being located adjacent the second end of the inlet manifold chamber;

wherein the fluid guides diverge as they progress from the first end towards the second end of the inlet manifold chamber, the fluid guides thereby causing fluid flowing from the first end to the second end of the inlet manifold chamber to be distributed over the width, in the row direction, of the second end thereof.

BRIEF DESCRIPTION OF THE DRAWINGS

The invention will now be described with reference to the drawings, which are representational only and are not to scale, and in which.

DETAILED DESCRIPTION OF THE DRAWINGS

Embodiments of the disclosure in general relate to a manifold component for a droplet ejection head.

Figure 1A:
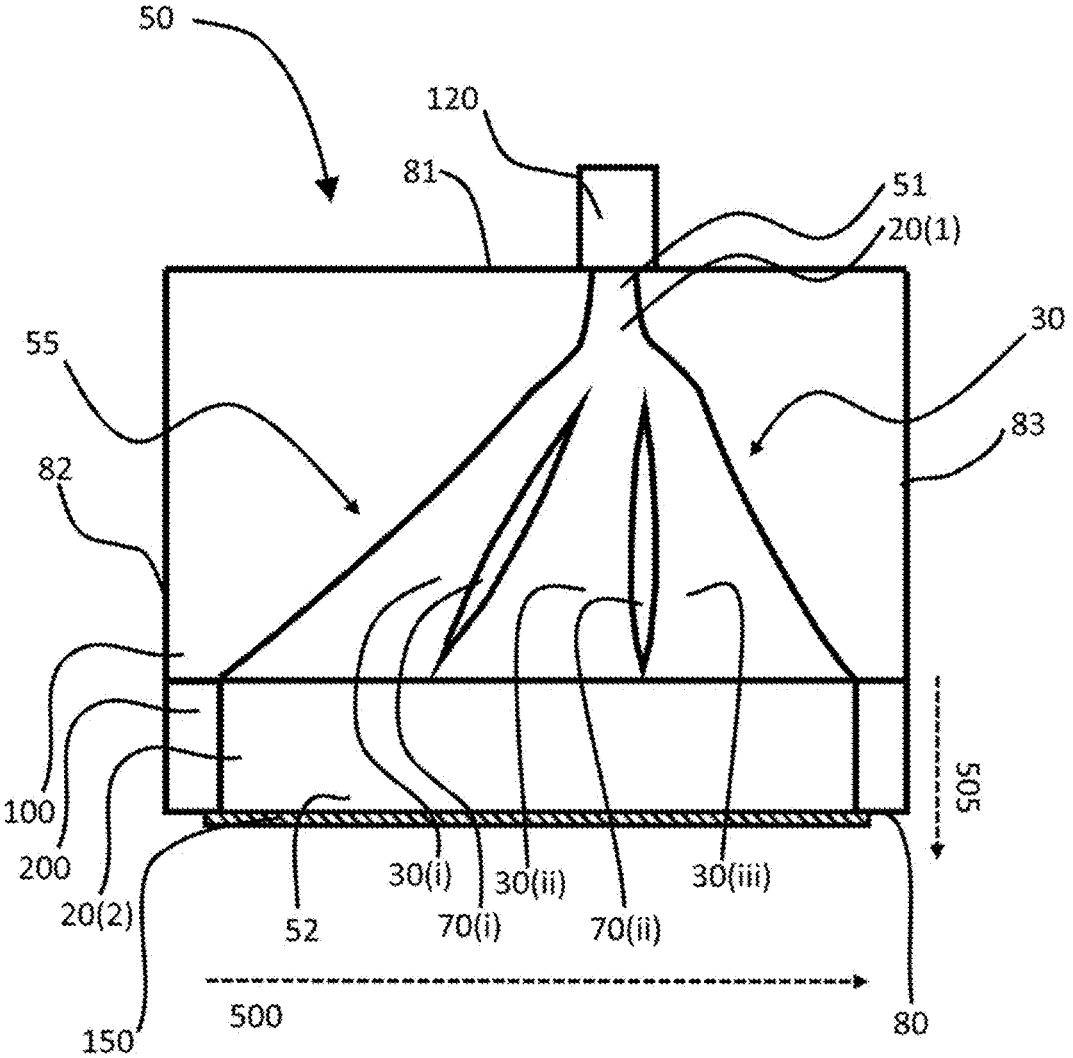
FIG. 1A is a cross-sectional view of a manifold component according to a first embodiment of the disclosure.
Figure 1B:
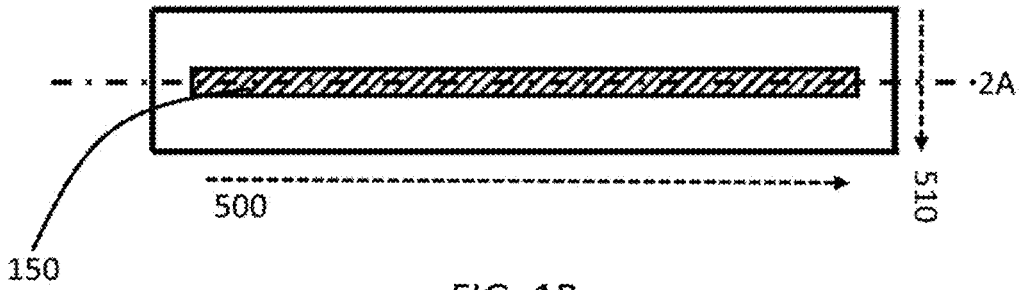
FIG. 1B is an end view of the manifold component shown in FIG. 1A.

Turning first to FIG. 1, shown is a manifold component 50 according to a first example embodiment. More particularly, FIG. 1A and FIG. 1B are, respectively, cross-sectional and end views of the manifold component 50.

As is apparent from the drawings, the manifold component 50 has a mount 80 for receiving an actuator component 150 that provides one or more rows of fluid chambers.

Each such chamber is provided with at least one actuating element (for example, a piezoelectric or other electromechanical actuating element, or a thermal actuating element) and at least one nozzle. The actuating element(s) for each chamber are actuable to eject a droplet of fluid in an ejection direction 505 (indicated by arrow 505 in FIG. 1A) through the nozzle(s) for that chamber. Further, each of the rows of fluid chambers extends in a row direction 500, indicated with respective arrows in FIGS. 1A and 1B.

As shown most clearly in FIG. 1A, the actuator component 150 may be attached (e.g. using adhesive) to the mount

80 of the manifold component 50, as part of an assembly process for making a droplet ejection head including the manifold component 50.

In the particular example embodiment of FIGS. 1A and 1B, the mount 80 is a flat receiving surface. However, this is by no means essential and, in other embodiments, the mount 80 may have more complex arrangements of mounting surfaces, connecting elements and/or receiving portions (e.g. for receiving screws or pins). In addition, or instead, the mount 80 may be configured such that the actuator component 150 is attached using a push fit or slide fit in addition to (or instead of) adhesive.

Referring again to FIG. 1A, it is apparent that an inlet manifold chamber 55 is provided within the manifold component 50. As may be seen, this inlet manifold chamber 55 extends from a first end 51 to a second end 52, with the second end 52 providing a fluidic connection, in parallel, to the chambers of the one or more rows of fluid chambers in the actuator component 150 (or a group of such chambers). It is further apparent from FIG. 1A that the manifold's second end 52 is located adjacent the mount 80 for the actuator component 150.

As may also be seen from FIG. 1, the manifold component 50 further includes an inlet port 120 which opens into the inlet manifold chamber 55 at its first end 51 so as to supply fluid thereto during operation.

As can be seen from FIG. 1A, the inlet manifold chamber 55 notably has a plurality of fluid guides 70(*i-ii*) disposed within the inlet manifold chamber 55. Each such fluid guide 70(*i-ii*) extends from a respective first end to a respective second end. As is apparent, in the particular embodiment shown in FIGS. 1A and 1B, the respective first ends of all the fluid guides 70(*i-ii*) are located adjacent the first end 51 of the inlet manifold chamber 55, whereas the second ends of all of the fluid guides are located adjacent to the second end 52 of the inlet manifold chamber 55. This is however by no means essential and, as will be described below with reference to FIGS. 3A, 3B and 7, for example, in other embodiments the first ends of only some of the fluid guides may be located adjacent the first end of the inlet manifold chamber and/or the second ends of only some of the fluid guides may be located adjacent the second end of the inlet manifold chamber.

As can also be seen from FIG. 1A, the fluid guides 70(*i-ii*) diverge as they progress from the inlet manifold chamber's first end 51 towards its second end 52 such that their respective first ends are spaced closer together in the row direction 500 than their respective second ends. The fluid guides thereby cause fluid flowing from the first end 51 to the second end 52 to be distributed over the width, in the row direction 500, of the second end 52.

As is further apparent from FIG. 1A, the inlet manifold chamber's width in the row direction 500 gradually increases from its first end 51 to its second end 52 so that the second end 52 is substantially wider, in the row direction 500, than its first end 51. For example in some implementations the width of the first end 51 may be 22% of the width of the second end 52. In other implementations the width of the first end 51 may be 6% of the width of the second end 52. In other implementations the width of the first end 51 may fall in the range between 6% and 22% of the width of the second end 52. Such a shape may, in some embodiments, aid in the fanning out of the fluid as it flows through the manifold chamber 55 from its first end 51 to its second end 52 and/or may reduce the likelihood of voids of trapped air forming.

As illustrated by FIG. 1A, each fluid guide 70(*i-ii*) may comprise a respective fluid-directing vane. Such vanes are straightforward to configure (for example by shaping and/or angling them), such that, in operation, they cause fluid flowing from the manifold chamber's first end 51 to its second end 52 to be distributed over the width, in the row direction 500, of the second end 52. Each vane may, for example, extend from one side of the manifold chamber 55 to the other, opposite side, such that the vane defines two separate fluid passageways within the manifold chamber, disposed on either side of the vane. However, it is not essential that each vane extends the entirety of the way from one side of the manifold chamber 55 to the other, and, in other embodiments, each vane (or a group of vanes) could extend only part-way across the manifold chamber 55.

Moreover, it is by no means essential that each fluid guide 70(*i-ii*) comprises a respective fluid-directing vane and, in other embodiments, other shapes and designs of fluid guides may be employed. For instance, in other embodiments, instead of (or in addition to) vanes, each fluid guide could include grooves in the internal surfaces of the inlet manifold chamber 55, and/or linear arrays of protrusions or obstacles (such as linear arrays of posts, pillars, columns, mounds, dimples etc.).

The inventors consider that the use of fluid guides 70(*i-ii*) in the inlet manifold chamber 55 in the manner described herein may assist with the priming of the manifold component 55 with fluid at the start of operation (e.g. prior to printing, in the case of a manifold component for use in a droplet ejection head configured as a printhead). Priming is an operation where a droplet ejection head that is empty of fluid and full of air is gradually filled with fluid by introducing fluid through the inlet port 120 into the inlet manifold chamber 55. The plurality of fluid guides 70(*i-ii*) may direct such fluid so as to reduce the likelihood that voids of trapped air are formed due to the manner in which such fluid progresses through the manifold chamber 55 from its first end 51 to its second end 52.

While in the particular embodiment shown in FIGS. 1A and 1B the manifold component 50 includes only two fluid guides 70(*i-ii*), it should be understood that in other embodiments a greater number of fluid guides may be employed, as is the case in the embodiments of FIGS. 2, 3A, 3B, 4B and 7.

Regardless of the particular number of them, the fluid guides 70(*i-ii*) may, in some embodiments, so direct and shape the fluid flow within the inlet manifold chamber 55 such that, on priming, the fluid within may arrive at the second end 52 of the inlet manifold chamber 55 largely as a flat front. Such an arrangement of fluid guides will be described in detail below with reference to FIG. 7.

Referring once more to FIG. 1A, it is apparent that the particular manifold component 50 shown includes two parts: first manifold part 100 and second manifold part 200. As is apparent, the first manifold part 100 provides the plurality of fluid guides, whereas the second manifold part 200 provides the mount 80 for the actuator component 150 (and does not provide any of the fluid guides 70(*i-ii*)). The manifold chamber 55 is however provided by both parts 100, 200 of the manifold component 50 (though more so by the first manifold part 100, for example so that the fluid guides may extend a majority of the length of the manifold chamber 55 in the ejection direction 505).

In some cases, where a manifold component includes such first and second manifold parts 100, 200, different, specifically-selected materials and/or manufacturing techniques may be used for each part. A possible consequence is that the manifold component 50 may be simple to manufacture/assemble while also having a long operational lifetime.

As an example, the first manifold part 100 may be made from a material such as a resin, thermosetting plastic, plastic/fibre composite material etc. that can be formed into complex shapes. This may, in some cases, aid in defining suitably precise shapes for the fluid guides 70.

The second manifold part 200 may, by contrast, be formed from a material having similar thermal properties (e.g. similar coefficient of thermal expansion) to the actuator component 150 (which may, in some embodiments, be manufactured largely from a silicon or piezoceramic material). This may, in some cases, reduce stresses induced in the actuator component 150 during assembly or operation.

Nonetheless, it should be understood that it is by no means essential that the manifold component includes two parts. In other embodiments, the manifold component could be a single, integrally-formed component, and in still other embodiments the manifold component could include multiple parts, for example with different, specifically-selected materials and/or manufacturing techniques being used for each such part.

Referring again to FIG. 1A, it is apparent that, in the particular embodiment shown, the manifold chamber 55 includes a first portion 20(1), which contains no fluid guides, a second portion 30, where the fluid guides 70(*i-ii*) are located, and a third portion 20(2), which again contains no fluid guides. It should be appreciated that, because the first and third portions 20(1), 20(2) are significantly smaller (in the ejection direction 505) than the second portion 30, the first ends of the fluid guides 70(*i-ii*) can nonetheless be considered as being adjacent the first end 51 of the manifold chamber 55, and the second ends can likewise be considered as being adjacent the second end 52.

Further, it should be understood that, while in the particular example embodiment shown in FIGS. 1A and 1B the mount 80 is configured to receive only one actuator component, in other embodiments it could be configured to receive two, three, four, or any suitable number of actuator components.

Figure 2A:
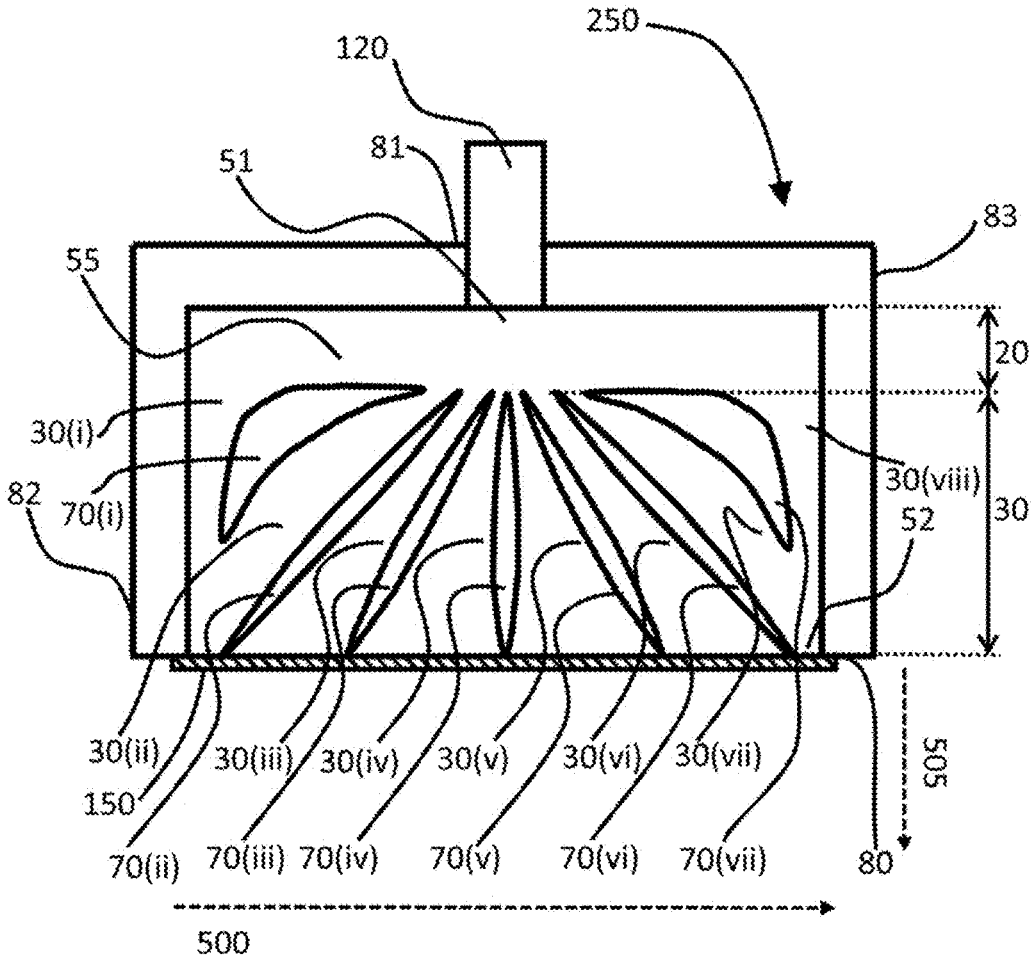
FIG. 2A is a cross-sectional view of a manifold component according to another embodiment, where the width of the manifold chamber is substantially constant.
Figure 2B:
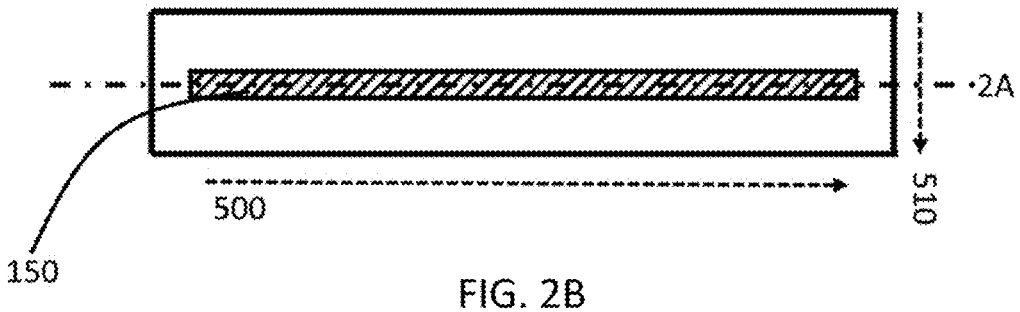
FIG. 2B is an end view of the manifold component shown in FIG. 2A.

Attention is now directed to FIG. 2, which shows a manifold component 250 according to another embodiment. More particularly, FIG. 2A and FIG. 2B show, respectively, a cross-sectional view and an end view of the manifold component 250. The embodiment shown in FIG. 2 is in many respects similar to that seen in FIG. 1 and thus, where appropriate, like reference numerals have been used.

As may be seen from FIG. 2A, in contrast to the embodiment depicted in FIG. 1, the inlet manifold chamber 55 of the manifold component 250 of FIG. 2 has a generally constant width in the row direction 500 and is therefore shown as having a rectangular cross-sectional shape in FIG. 2A. As is apparent, the fluid guides 70(*i-vii*) accordingly have somewhat different shapes to those of the manifold component of FIG. 1.

Furthermore, as with the embodiment shown in FIGS. 1A and 1B, the respective first ends of all the fluid guides 70(*i-vii*) of the manifold component of FIGS. 2A and 2B are located adjacent the first end 51 of the inlet manifold chamber 55, and the second ends of the more central fluid guides 70(*ii*-vi) are located adjacent to the second end 52 of the inlet manifold chamber 55. The outermost fluid guides 70(*i*) and 70(*vii*) in the row direction 500 have their respective second ends spaced apart from the second end 52 of the inlet manifold chamber 55. Put simply, the outermost fluid guides 70(*i*) and 70(*vii*) are shorter in the ejection direction 505 than the more central fluid guides 70(*ii*-vi).

As for the embodiment depicted in FIG. 1, the manifold component 250 in FIG. 2 has a portion 20(1) proximate the first end 51 of the manifold chamber 55 which contains no fluid guides. There is then a portion 30 located between the portion 20(1) and the second end 52 which contains a plurality of fluid guides 70(*i-vii*). In the manifold component 250 there are seven fluid guides 70(*i-vii*) that divide the portion 30 of the manifold chamber 55 into eight fluid passageways 30(*i-viii*) in the row direction 500, i.e. the plurality of fluid guides 70(*i-vii*) define at least one side-by-side array of fluid passageways 30(*i-viii*), with each fluid guide separating neighbouring fluid passageways within one such array.

It may be noted that the inlet port in FIGS. 1 and 2 is located, with respect to the ejection direction 505, at the opposite end of the manifold component 50 to the mount 80. However, this is by no means essential and in other embodiments the inlet port might instead be provided on a side of the manifold component 50 with respect to the ejection direction 505.

Figure 3A:
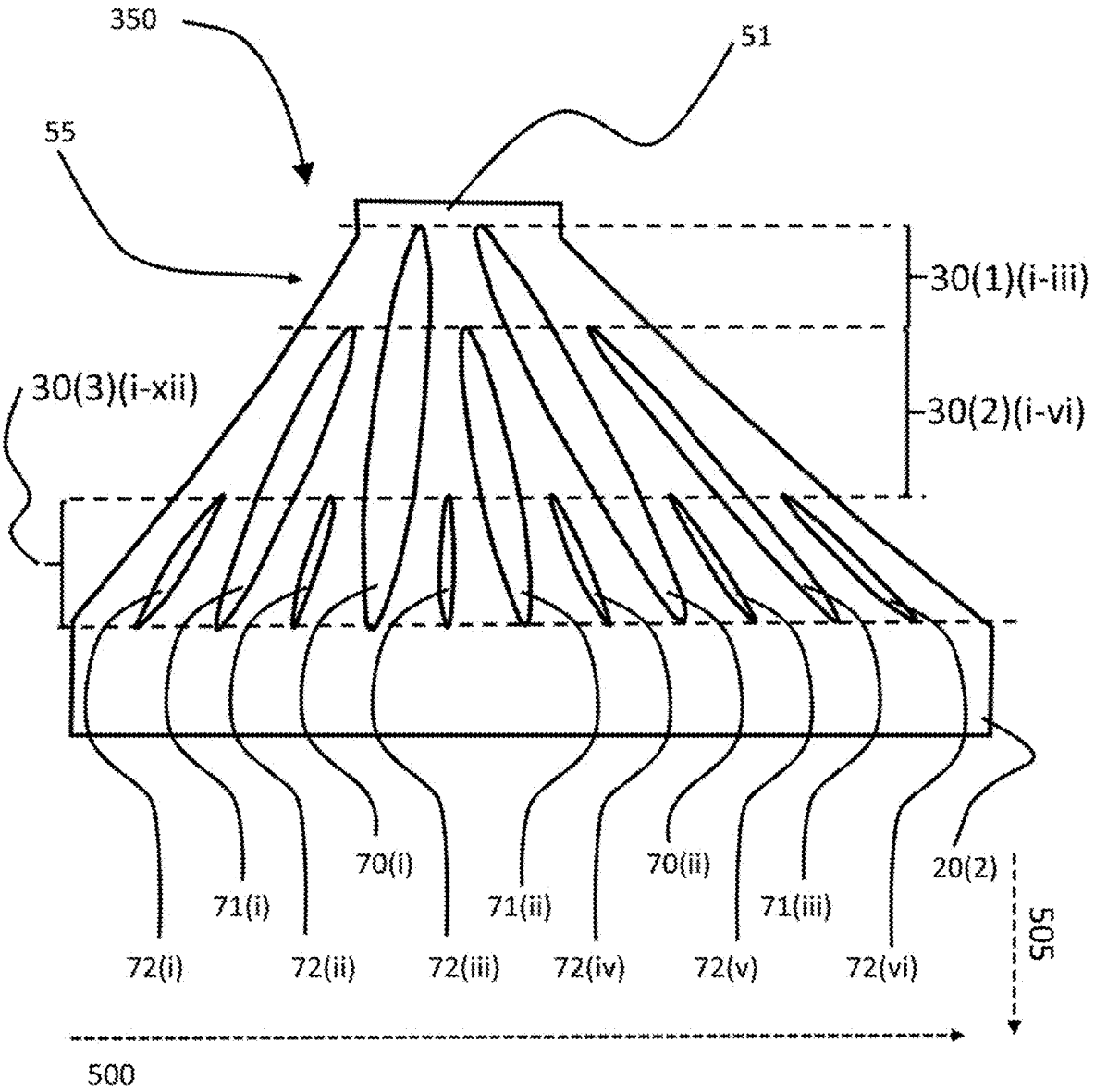
FIG. 3A is a manifold component according to another embodiment with a hierarchical arrangement of fluid passageways defined by a plurality of fluid guides.

Turning now to FIG. 3A, shown is a manifold component 350 according to a further embodiment. More particularly, FIG. 3A depicts a cross-section through the manifold chamber 55 of this manifold component 350, thereby showing the fluidic paths within the manifold chamber 55. As may be seen from FIG. 3A, the manifold component 350 includes a plurality of fluid guides 70(*i-ii*), 71(*i-iii*) and 72(*i-vi*) that are so-arranged as to define several hierarchical arrays of fluid passageways.

In more detail, as can be seen from FIG. 3A, defined within the manifold component 350 is a plurality of side-by-side arrays of fluid passageways 30(1)(*i-iii*), 30(2)(*i-vi*) and 30(3)(*i-xii*), including an initial array of fluid passageways 30(1)(*i-iii*), which is adjacent the first end 51 of the inlet manifold chamber 55 and a final array of fluid passageways 30(3)(*i-xii*), which is adjacent the second end 52 of the inlet manifold chamber 55.

As is apparent, the arrays 30(1)(*i-iii*), 30(2)(*i-vi*) and 30(3)(*i-xii*), are arranged consecutively from the first end 51 to the second end 52 of the inlet manifold chamber 55, with the number of fluid passageways in each array increasing progressively from the initial array 30(1)(*i-iii*), to the final array 30(3)(*i-xii*). For instance, in the particular embodiment shown in FIG. 3A, the initial array of fluid passageways 30(1)(*i-iii*) includes three fluid passageways, the consecutive (second) array of fluid passageways 30(2)(*i-vi*) includes six fluid passageways, and the final array of fluid passageways 30(3)(*i-xii*) includes 12 fluid passageways.

Such an arrangement may conversely be considered as providing decreasing numbers of fluid passageways towards the first end 51 of the manifold chamber 55, where the inlet port 120 is located. This may assist the flow of fluid through the manifold chamber 55 in the vicinity of the inlet port 120. Furthermore, in embodiments such as those shown in FIGS. 1A, 1B and 3A, where the manifold chamber's width in the row direction 500 increases (e.g. gradually increases) from its first end 51 to its second end 52, such an arrangement of fluid passageways may suitably account for the narrower extent of the first end 51 of the manifold chamber, again assisting the flow of fluid through the manifold chamber 55 in the vicinity of the inlet port 120.

Such an arrangement is considered to be particularly suitable (but is by no means exclusively suitable) where the manifold chamber 55 is relatively wide, for example, where its extent, in the row direction 500, at its second end 52, is greater than its extent in the ejection direction 505.

Referring once more to FIG. 3A, it is apparent that, in the illustrated hierarchical arrangement, a fluid passageway in a given one of the arrays 30(1)(*i-iii*), 30(2)(*i-vi*) and 30(3)(*i-xii*) is fluidically connected to (at least) two fluid passageways in the consecutive array nearer the second end 52 of the manifold chamber 55.

Considering now the arrangement of the fluid guides 70(*i-ii*), 71(*i-iii*) and 72(*i-vi*) that define the arrays of fluid passageways, it will be noted that only a first group of the fluid guides 70(*i-ii*) have their respective first and second ends located adjacent the first and second ends 51 and 52 of the inlet manifold chamber 55 respectively. By contrast, a second group of the fluid guides 71(*i-iii*) and 72(*i-vi*) has their respective first ends spaced apart from the first end 51 of the inlet manifold chamber 55; their respective second ends are however located adjacent the second end 52 of the manifold chamber. Put simply, fluid guides in the second group 71(*i-iii*) and 72(*i-vi*) are shorter in the ejection direction 505 than those in the first group 70(*i-ii*).

It may also be noted that, in the particular embodiment shown, the second group of fluid guides 71(*i-iii*) and 72(*i-vi*) includes two sub-sets of fluid guides, the first ends of the fluid guides in each subset spaced apart from the first end 51 of the inlet manifold chamber 55 by a corresponding distance. As illustrated, the respective first ends of the fluid guides in subset 71(*i-iii*) are spaced from the first end 51 of the inlet manifold chamber 55 by a smaller distance than are the respective first ends of the fluid guides in subset 72(*i-vi*).

Figure 3B:
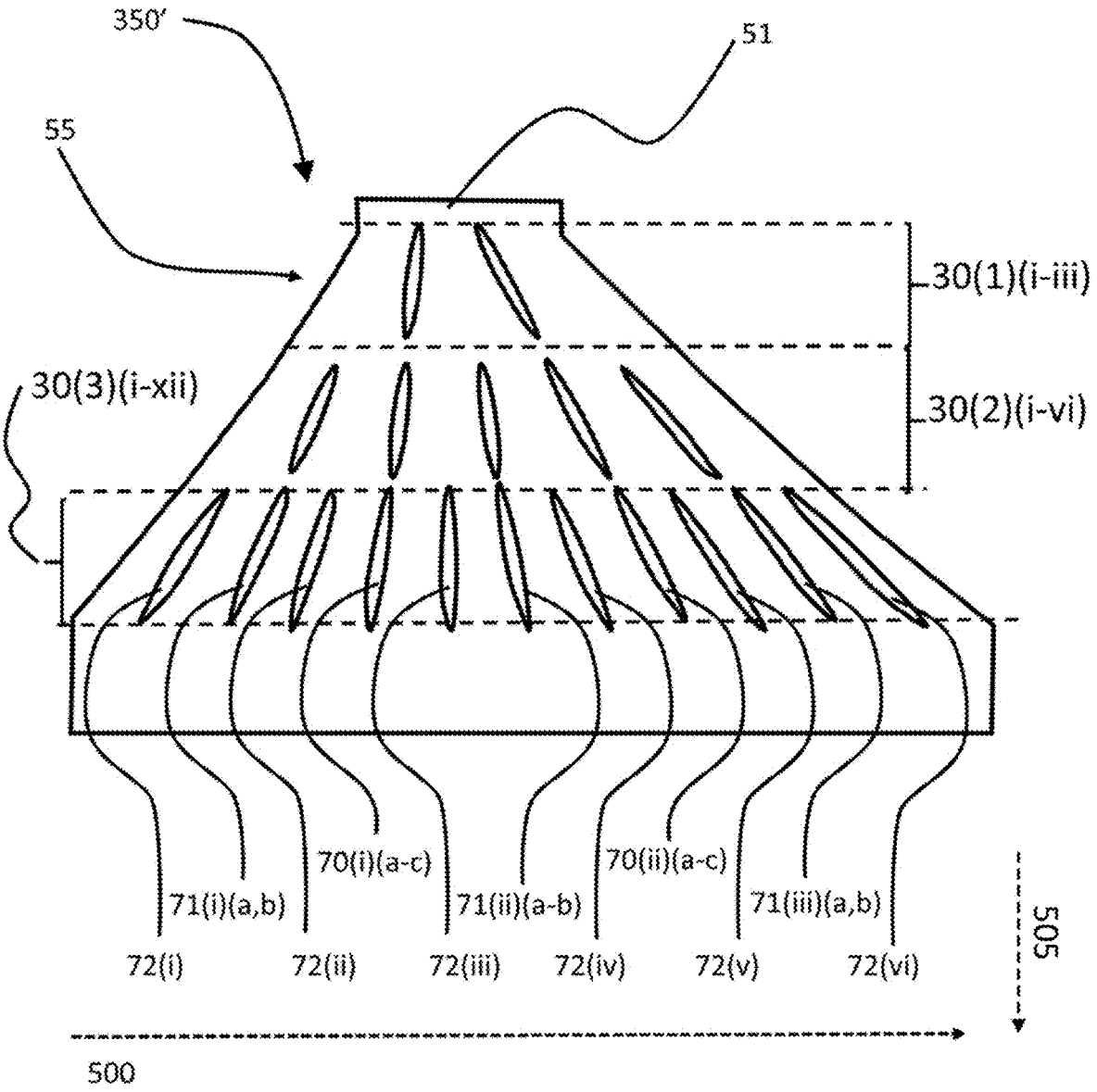
FIG. 3B is manifold component similar to that in FIG. 3A with a different hierarchical arrangement of fluid passageways defined by a plurality of fluid guides.

Turning now FIG. 3B, shown is a manifold component 350' according to yet another embodiment. More particularly, FIG. 3B depicts a cross-section through the manifold chamber 55 of manifold component 350', thereby showing the fluidic paths within the manifold chamber 55. The manifold component 350' of FIG. 3B has a similar hierarchical arrangement of fluid passageways to that of the embodiment of FIG. 3A. However, in the manifold component of FIG. 3B, certain fluid guides include multiple, closely-spaced and aligned elongate vanes, rather than a single vane, as is the case in FIG. 3A. As an example, in the particular embodiment shown, fluid guides 70(*i,ii*) each includes a series of three closely-spaced and aligned elongate vanes 70(*i,ii*)(a-c). Similarly, fluid guides 71(*i-iii*) each include a series of two elongate vanes 71(*i-iii*)(a-b) that are closely-spaced and aligned.

It should be appreciated that such a series of vanes, in some cases (e.g. as a result of suitable spacing, alignment and/or shape), may have broadly the same general overall effect on fluid flow as the fluid guides 70(*i,ii*) and 71(*i-iii*) depicted in FIG. 3A, which include only a single vane.

Figure 4A:
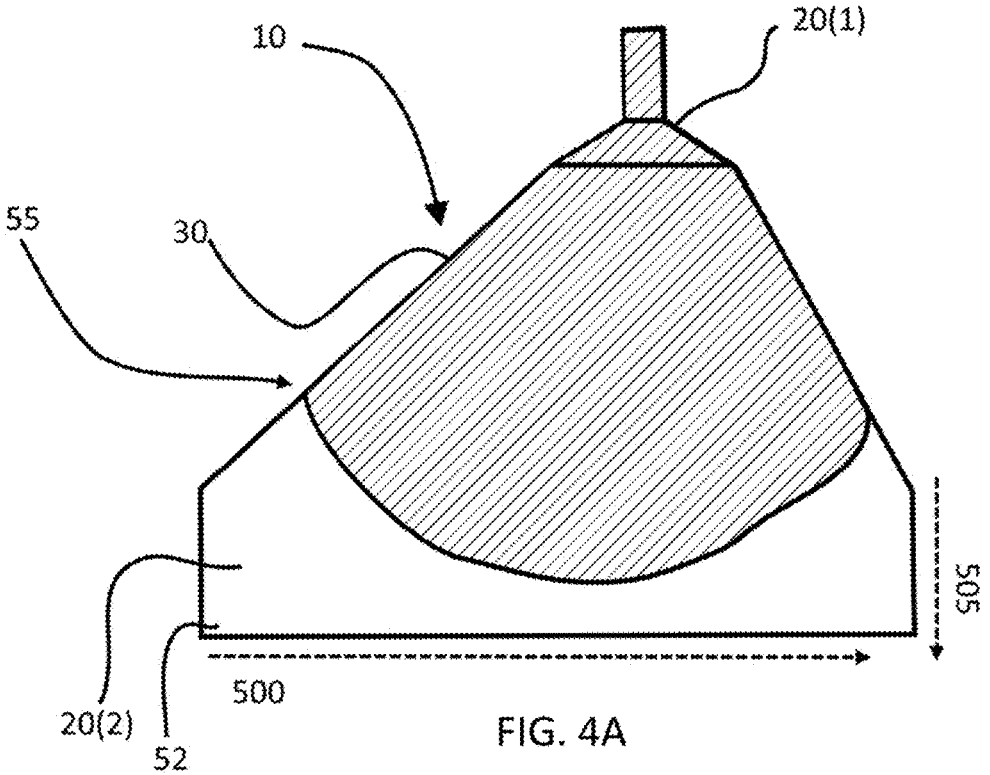
FIG. 4A is the fluidic path in a manifold component according to a first test design at an instance in time.
Figure 4B:
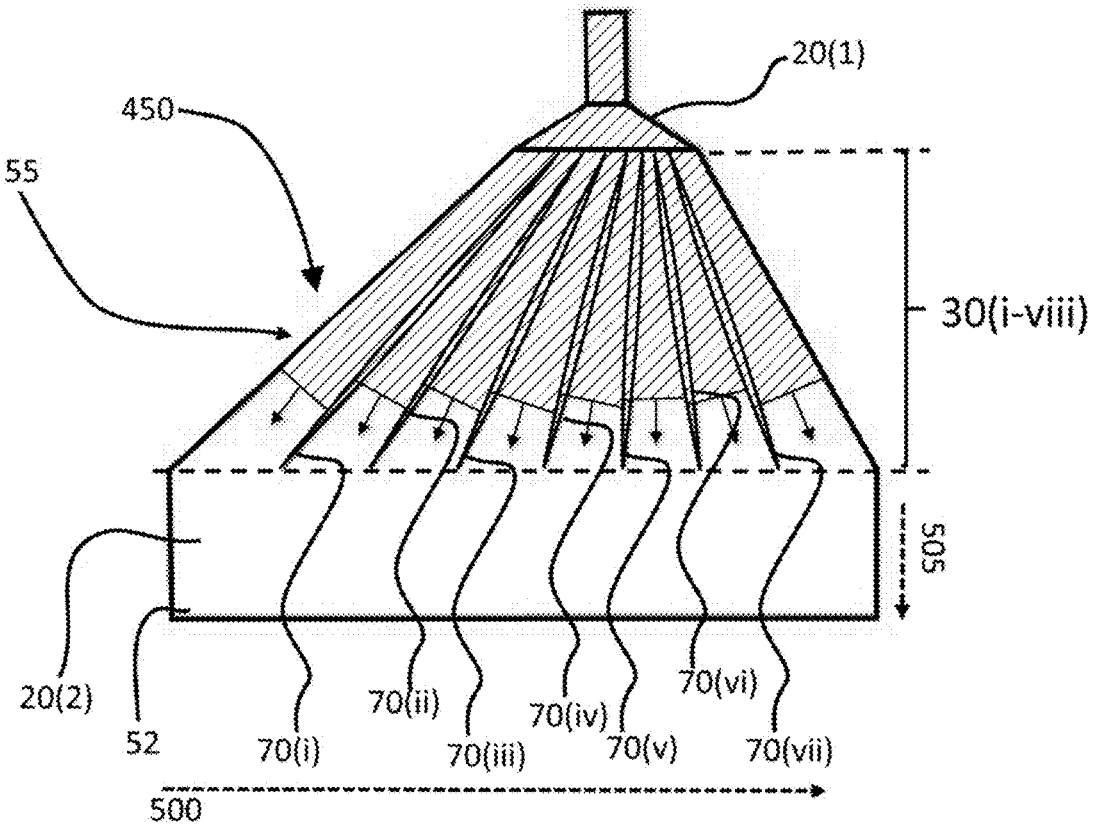
FIG. 4B is the fluidic path in a manifold component according to another embodiment at the same time instance as in FIG. 4A.

Attention is now directed to FIG. 4A and FIG. 4B, which depict, respectively, cross-sectional views of a manifold component 10 according to a first comparative example, and a manifold component 450 according to a further embodiment. Both views are taken at the same instance in time after the introduction of fluid into the manifold components 10, 450 via their respective inlet ports, as part of a priming process. As may be seen from FIG. 4A and FIG. 4B, in both cases the fluid has yet to reach the second end 52 of the manifold chamber 55. The manifold components 10, 450 shown in FIGS. 4A and 4B share several features with the embodiments described above, and thus, where appropriate, like reference numerals have been used.

As is apparent from a comparison of FIGS. 4A and 4B, the manifold component 10 according to the comparative example has a manifold chamber 55 of generally the same shape as that of the embodiment of FIG. 4B; the manifold components 10, 450 differ only in that the manifold component 450 shown in FIG. 4B includes a plurality of fluid guides 70(*i-vii*) within its manifold chamber 55, whereas the manifold component 10 of the comparative example shown in FIG. 4A does not. It may be seen from FIG. 4B that the fluid guides 70(*i-vii*) in the manifold component 450 diverge as they progress from the inlet manifold chamber's first end 51 towards its second end 52 such that their respective first ends are more closely spaced than their respective second ends. It may also be seen that the fluid guides 70(*i-ii*) are not equally spaced at their respective first and second ends such that the fluid passageways 30(*i-viii*) are not identical.

It may clearly be seen from comparing FIG. 4B with FIG. 4A that the effect of the fluid guides 70(*i-vii*) is that the fluid guides act to slow the fluid in the centre of the manifold chamber 55, with respect to the row direction 500, such that the fluid front is considerably flatter in the manifold chamber in FIG. 4B. The inventors consider that such fluid guides may assist with the priming of the manifold component 450 by reducing the likelihood that air-filled voids are formed during the priming process.

Figure 5A:
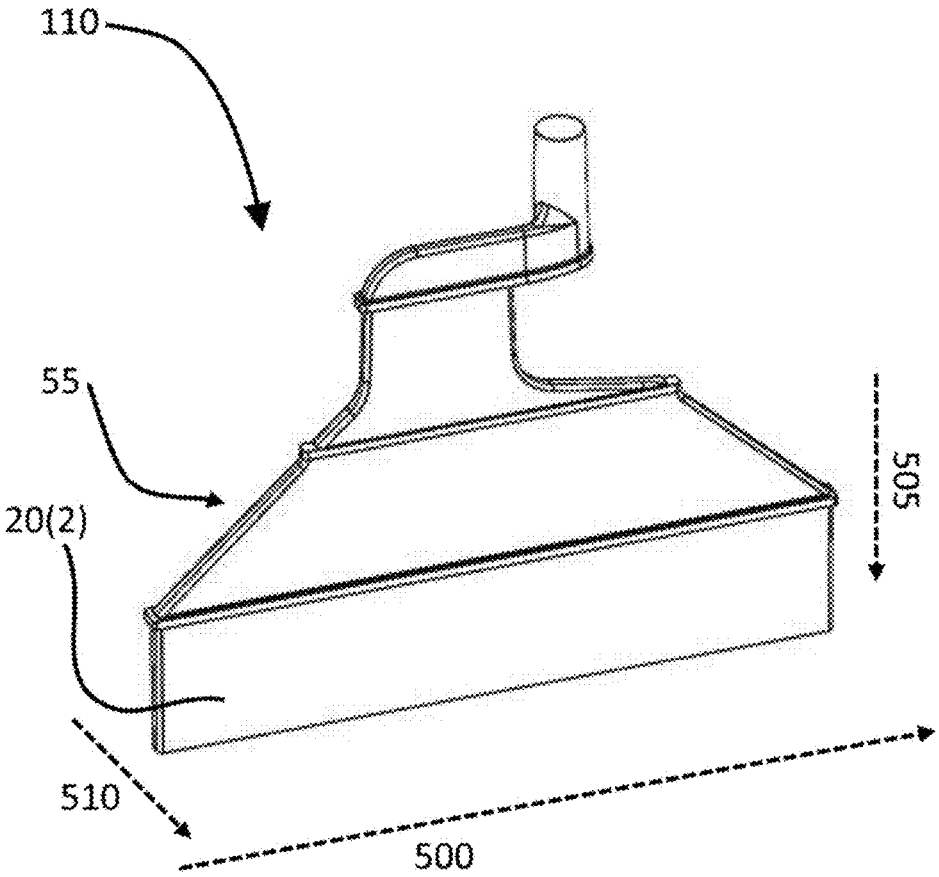
FIG. 5A is a perspective view of the fluidic paths inside a test manifold component.
Figure 5B:
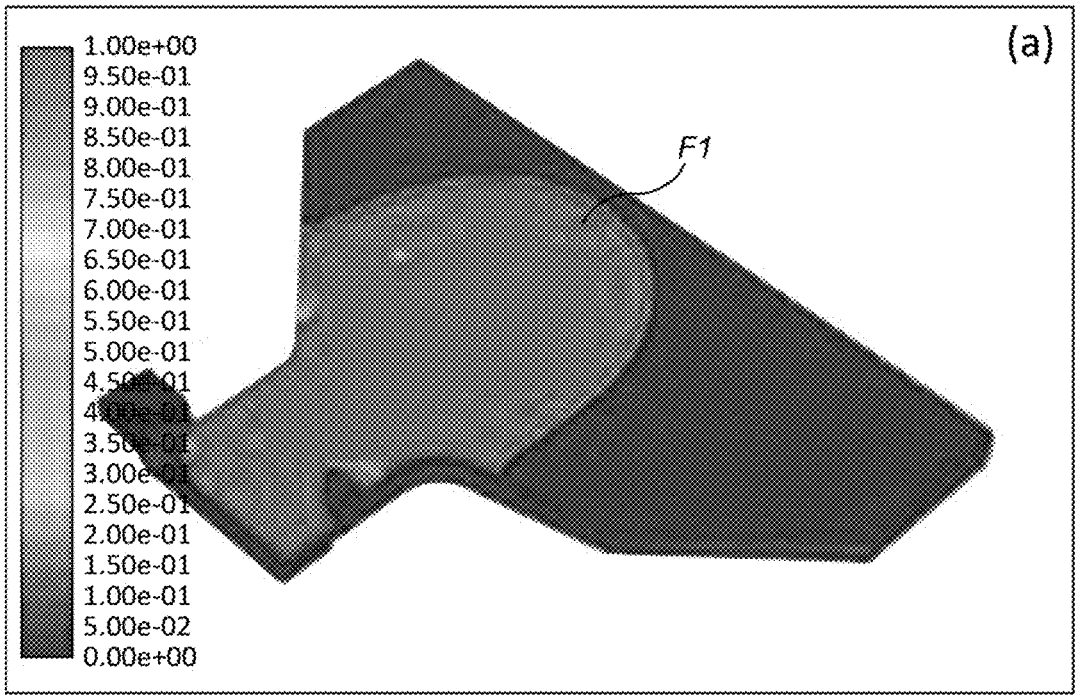
FIG. 5B is a series of illustrations of the calculated fluid and air positions at a number of time intervals during the priming (i.e. filling with fluid) of a test manifold component as per FIG. 5A.
Figure 5B:
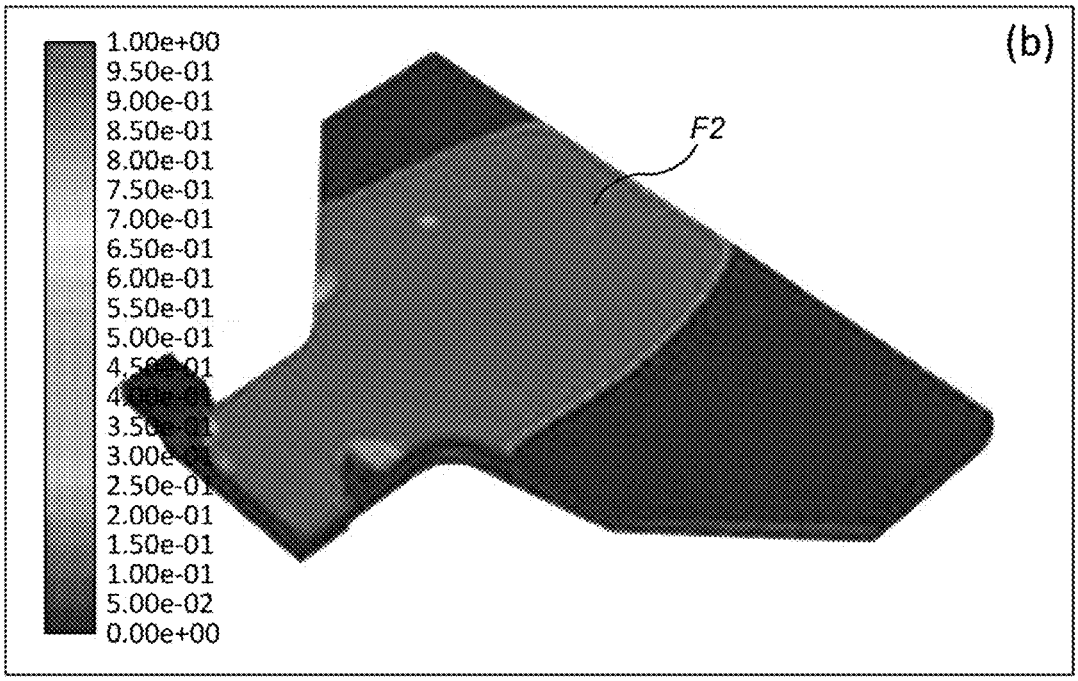
Figure 5B:
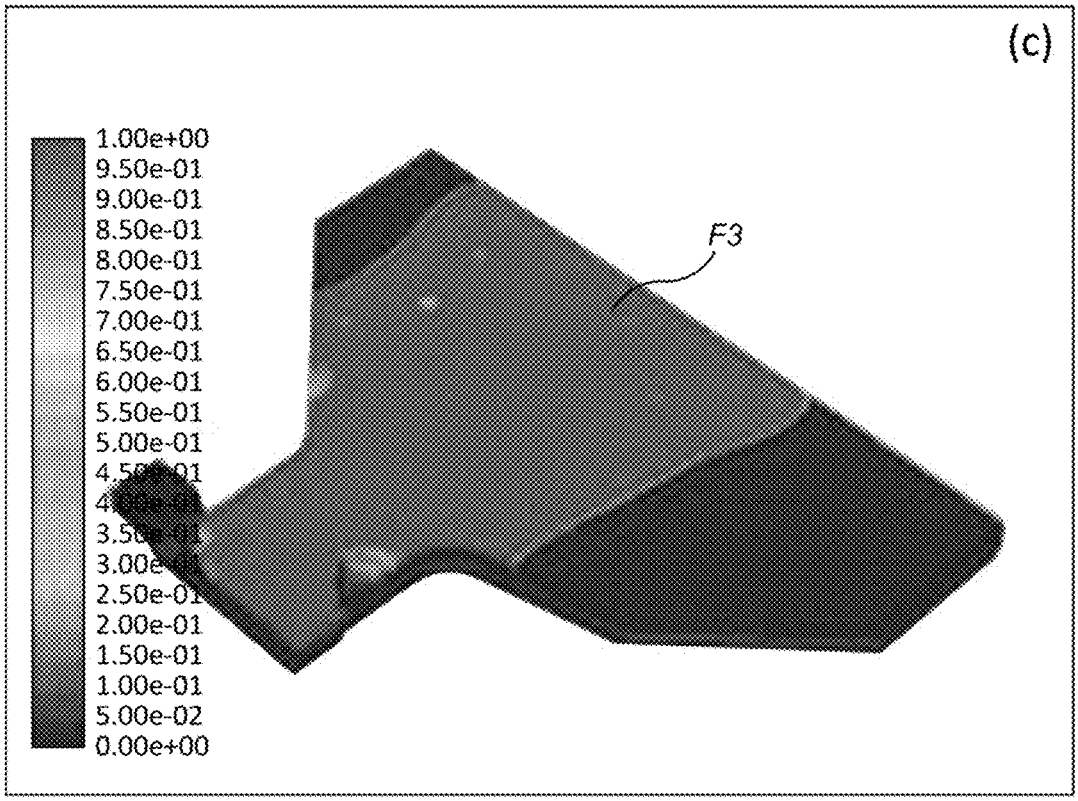
Figure 5B:
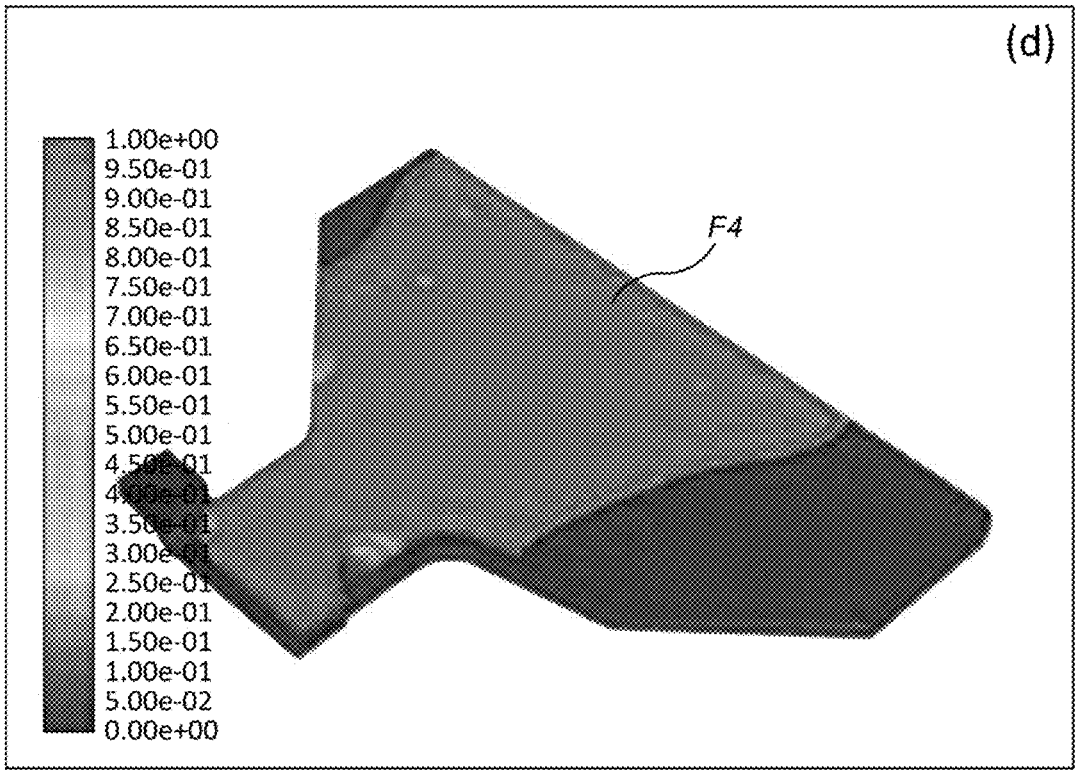
Figure 5B:
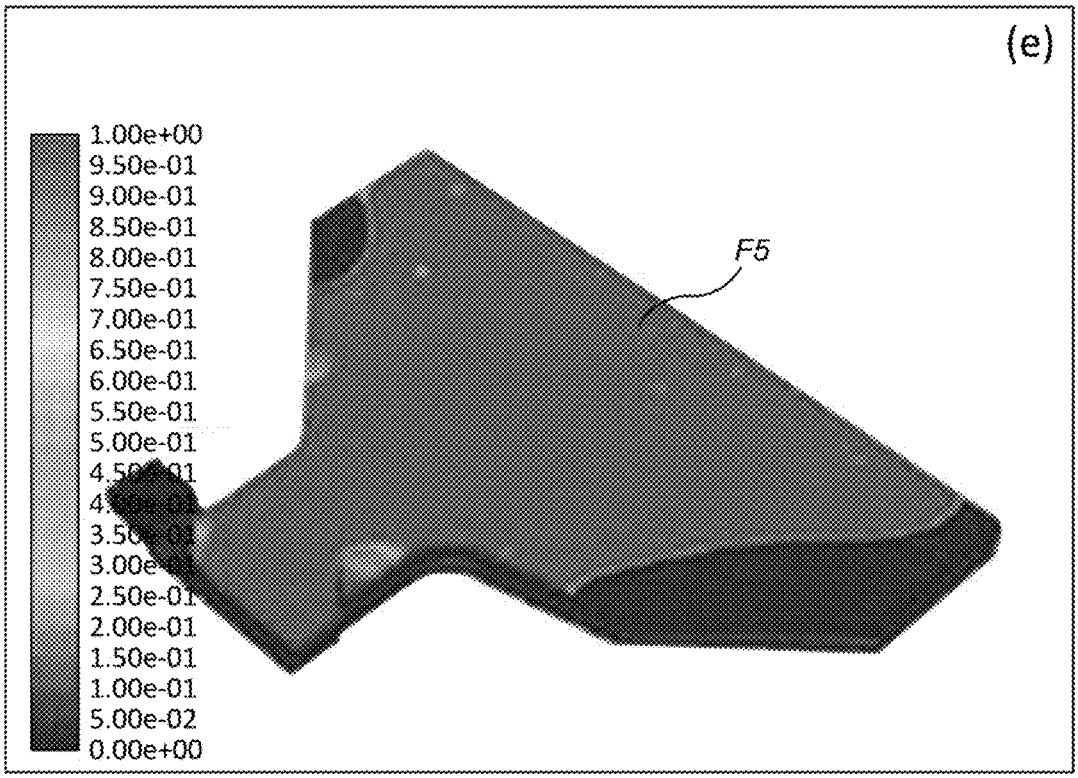
Figure 5B:
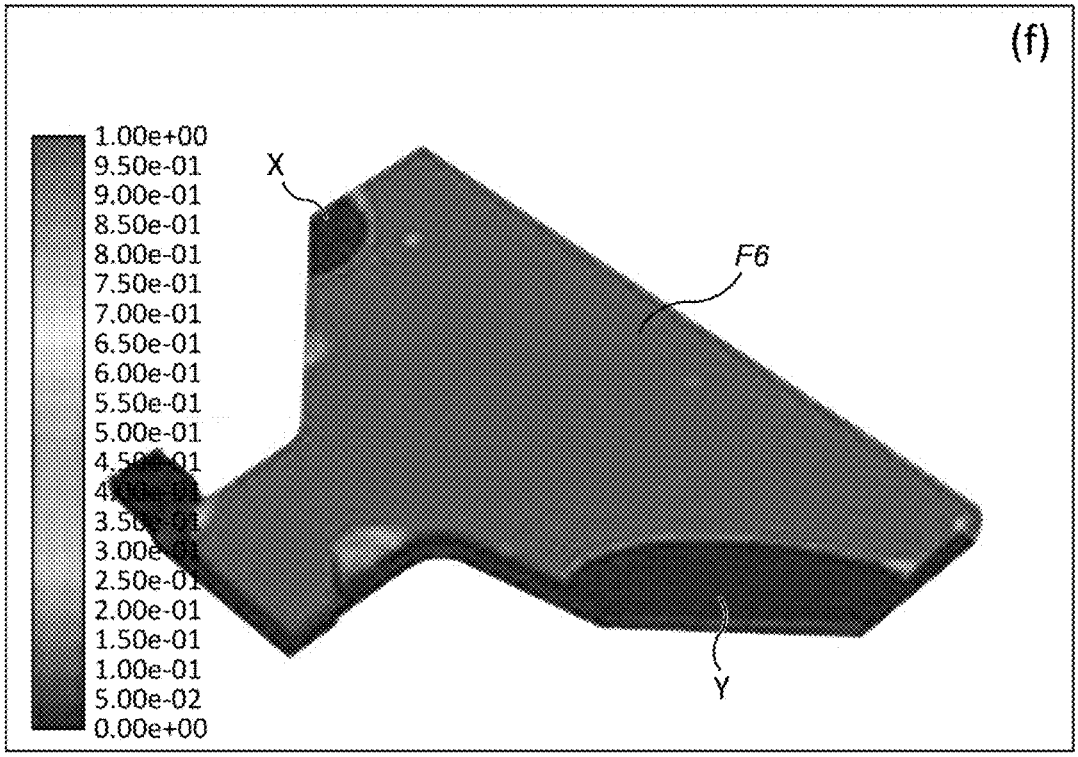

Attention is now directed to FIG. 5A, which depicts a perspective view of the fluidic paths inside a test manifold component 110 according to a comparative example. FIG. 5B shows a series of illustrations of the computationally-modelled fluid positions (labelled F1 to F6) and air positions at a number of time intervals during the priming of the manifold component 110 of FIG. 5A, wherein the key in FIGS. 5B(a)-(f) depicts the volume fraction of fluid. The computational modelling was performed using computational fluid dynamics (CFD) techniques. It can be seen that fluid initially flows down through the centre of the inlet manifold chamber 55 and then spreads to its outer edges. Notably, it can be seen that, at the end of the priming process, there are air-filled voids (e.g. X and Y) on either side of the inlet manifold chamber 55 that have not been filled with fluid. Such voids may, in some cases, cause a droplet ejection head including the manifold component 110 to perform poorly.

Figure 6A:
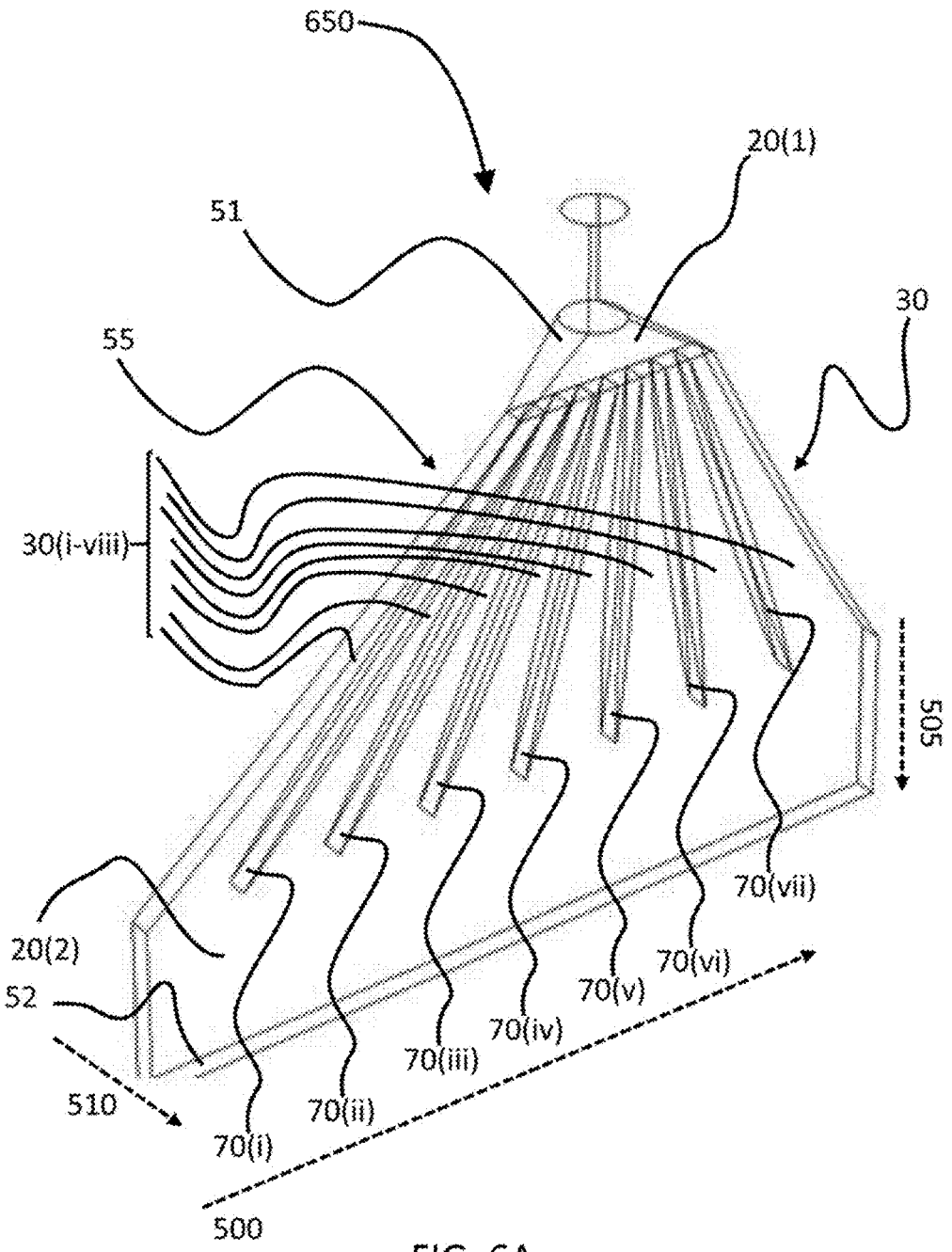
FIG. 6A is a perspective view of the fluidic paths inside a manifold component according to another embodiment.

Attention is further directed to FIG. 6A, which is a perspective view of the fluidic paths inside a manifold component 650 according to a further embodiment. It should be appreciated that the respective manifold chambers within the manifold components of FIGS. 5A and 6A have shapes that are generally functionally equivalent; for instance, both have the same geometry for their second ends 52; and in both, the location where the inlet port opens into the manifold chamber 55 has the same position relative to the corresponding second end 52. Similarly to the manifold components of FIGS. 4A and 4B, the manifold components 110, 650 of FIGS. 5A and 6A differ primarily in that the manifold component 650 shown in FIG. 6A includes a plurality of fluid guides 70(*i-vii*) within its manifold chamber 55, whereas the manifold component 110 of the comparative example shown in FIG. 5A does not.

Figure 6B:
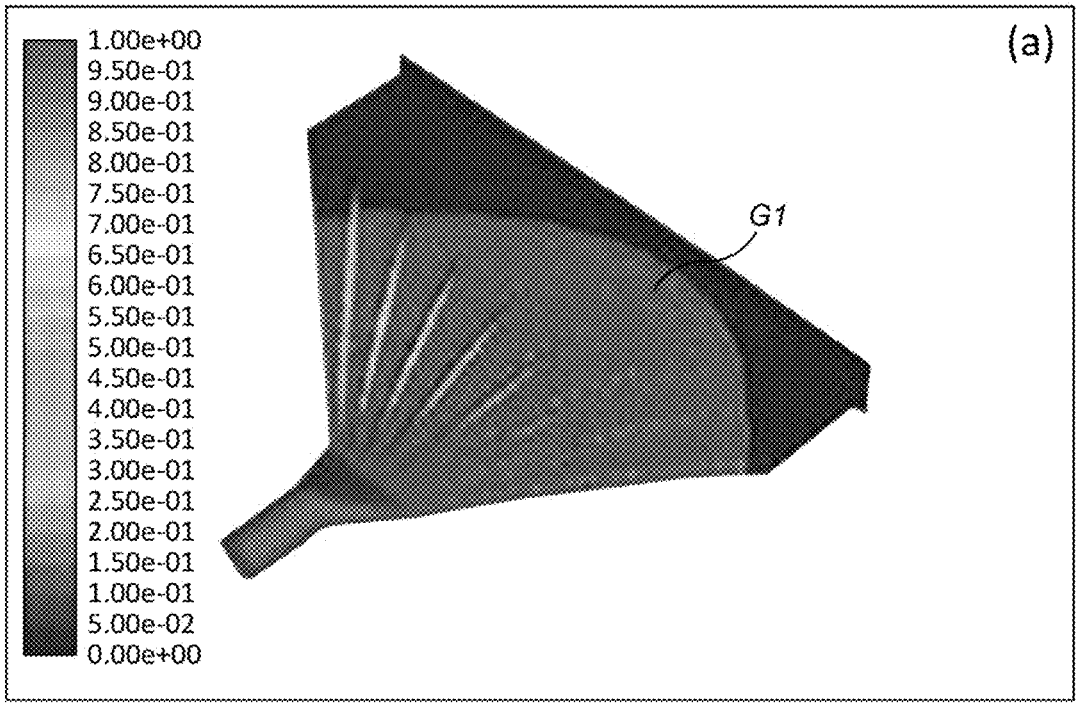
FIG. 6B is a series of illustrations of the calculated fluid and air positions at a number of time intervals during the priming of a manifold component as per FIG. 6A.
Figure 6B:
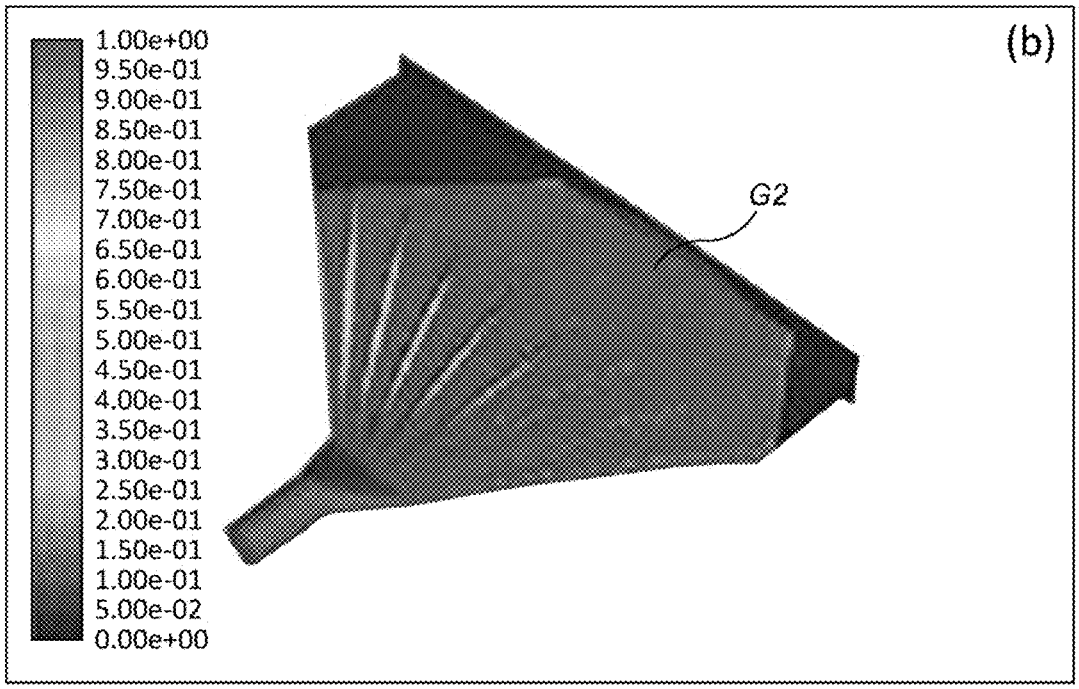
Figure 6B:
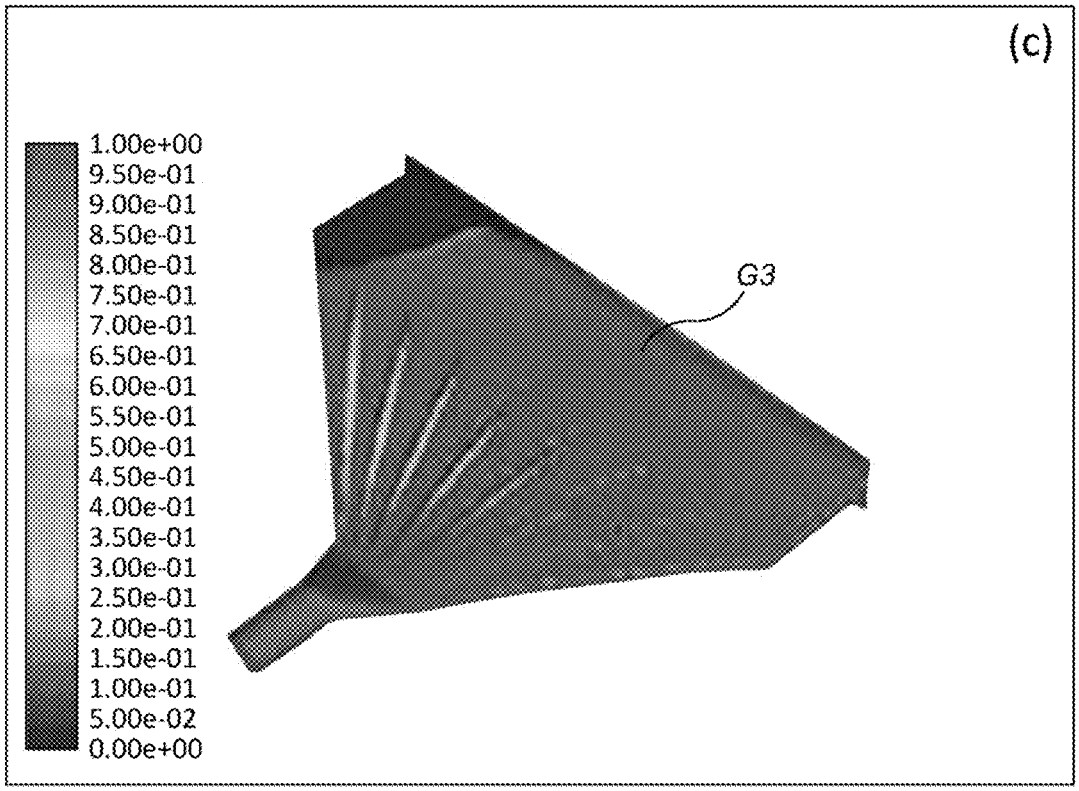
Figure 6B:
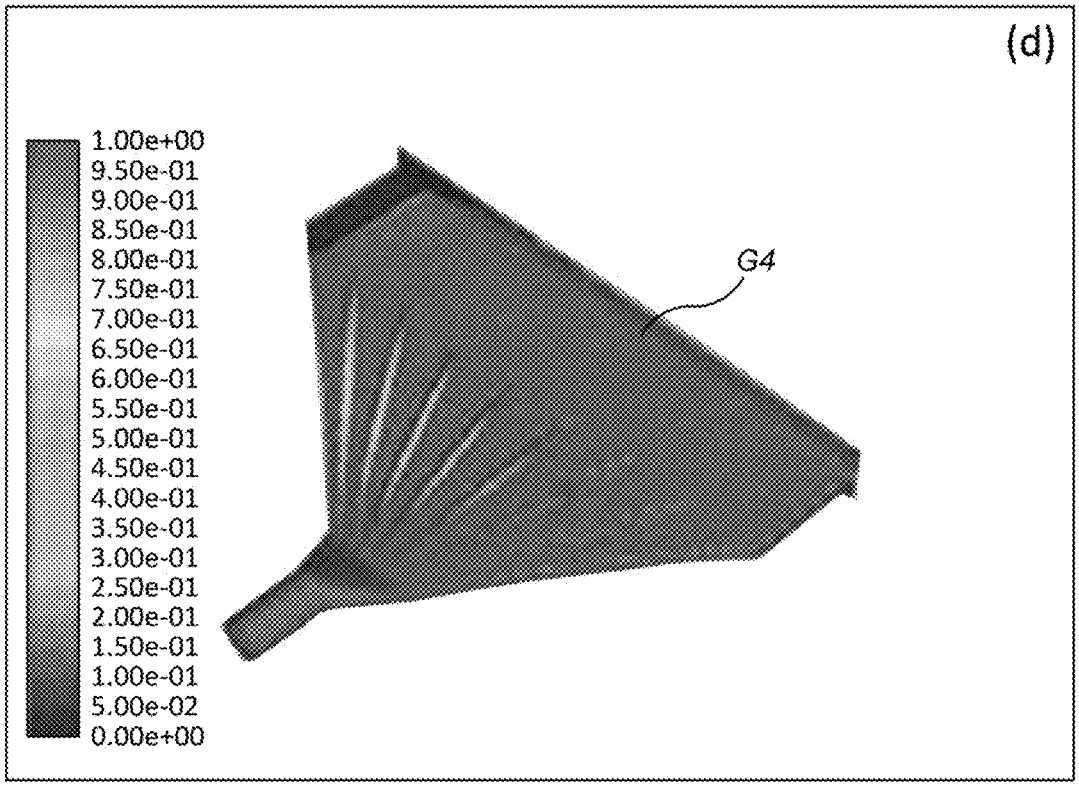
Figure 6B:
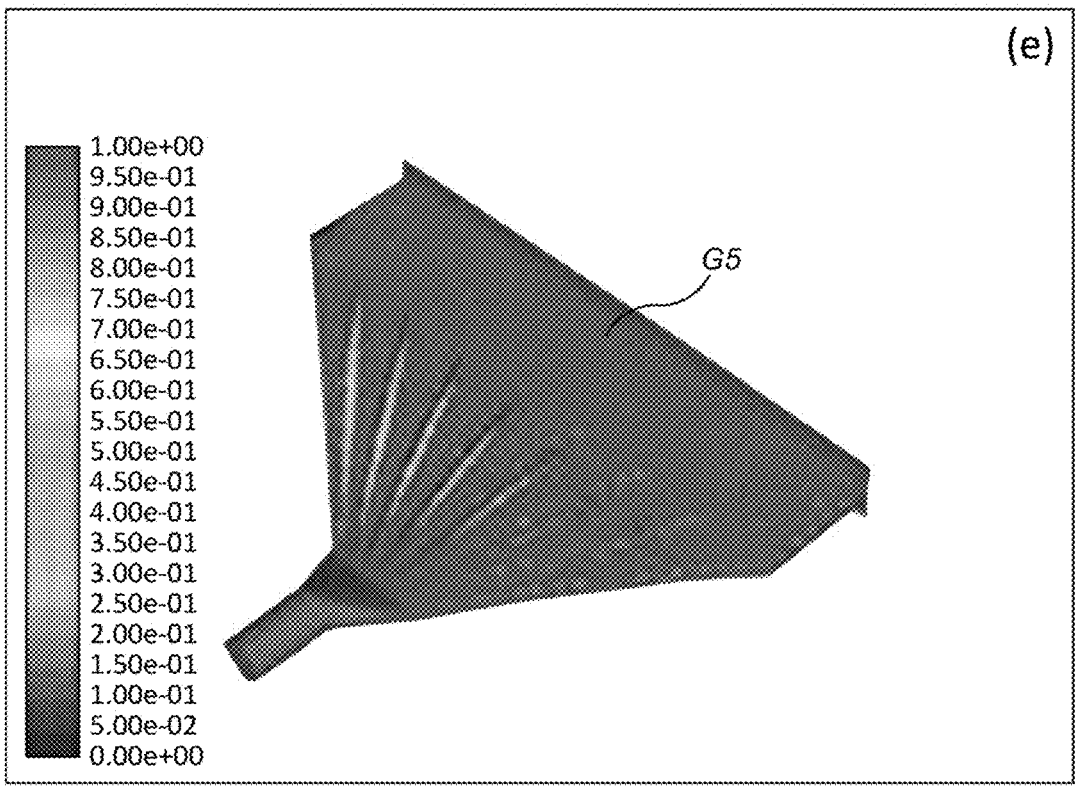
Figure 6B:
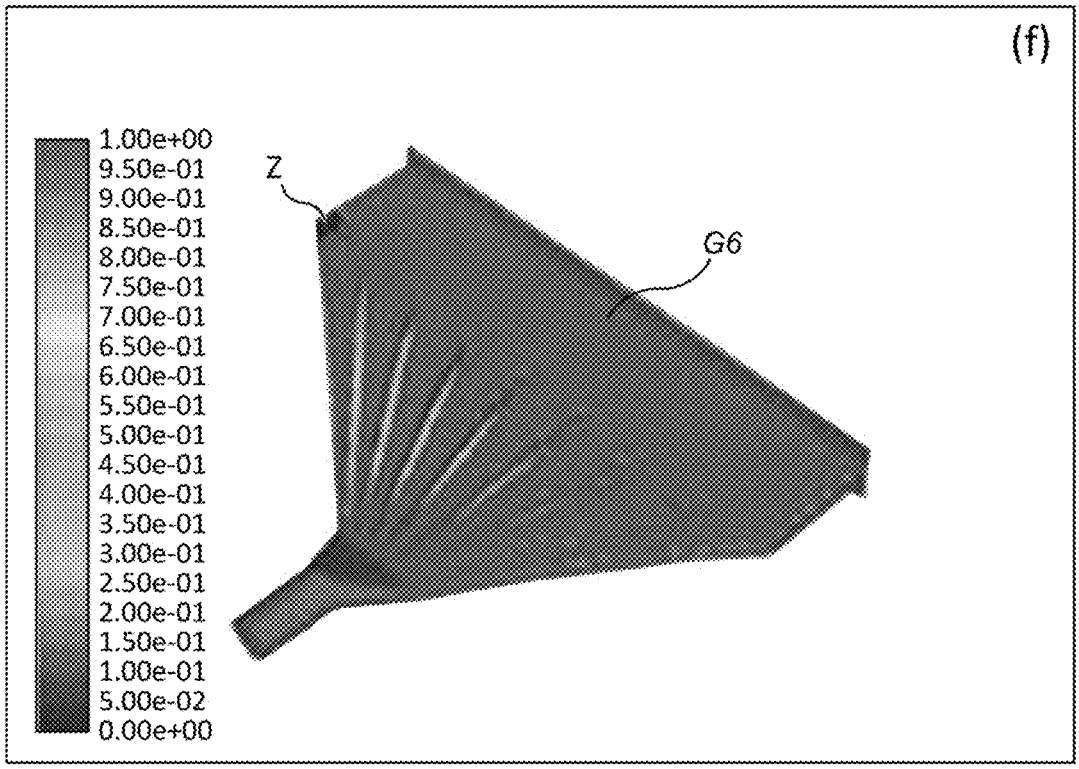

FIG. 6B shows a series of illustrations of computationally-modelled fluid positions (labelled G1 to G6) and air positions at a number of time intervals during the priming of the manifold component 650 of FIG. 6A, wherein the key in FIGS. 6B(*a*)-(*f*) depicts the volume fraction of fluid. More particularly, FIG. 6B shows the priming process for the manifold component 650 of FIG. 6A at the same six time instances as shown in FIG. 5B.

It may be seen from a comparison of FIG. 6B with FIG. 5B that the manifold component 650 of FIG. 6A, which notably has a plurality of fluid guides arranged in a manner described herein, has an improved extent of priming of the inlet manifold chamber 55. Only small or negligible voids (e.g. Z) are present at the final time intervals, as compared with the priming extent of the comparative example of the manifold component 110 of FIG. 5A, which has no fluid guides.

Figure 7:
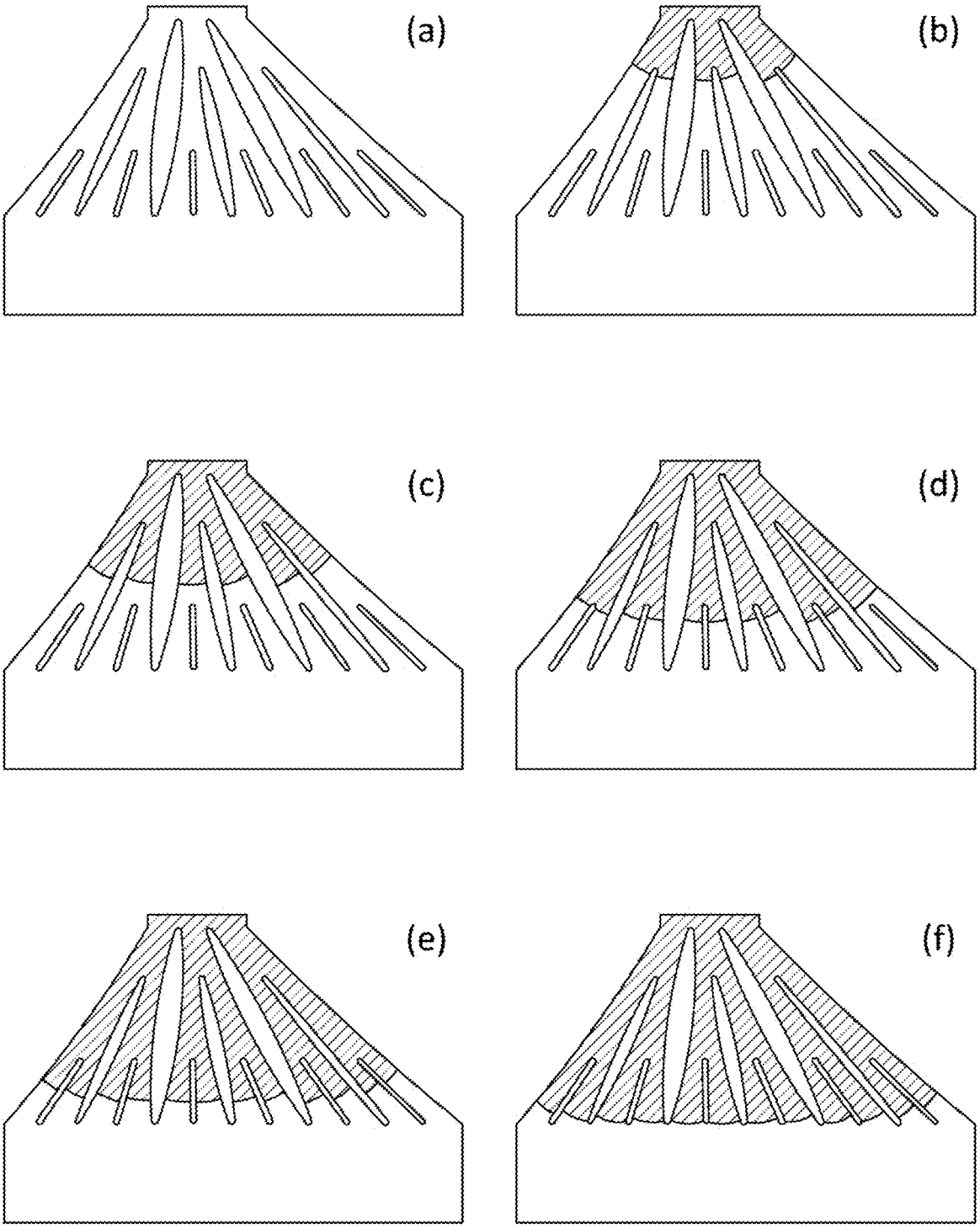
FIG. 7 is a series of illustrations of a cross-sectional view of an inlet manifold chamber according to an embodiment similar to that in FIG. 3 at a number of points in time during the calculated priming process.
Figure 7:
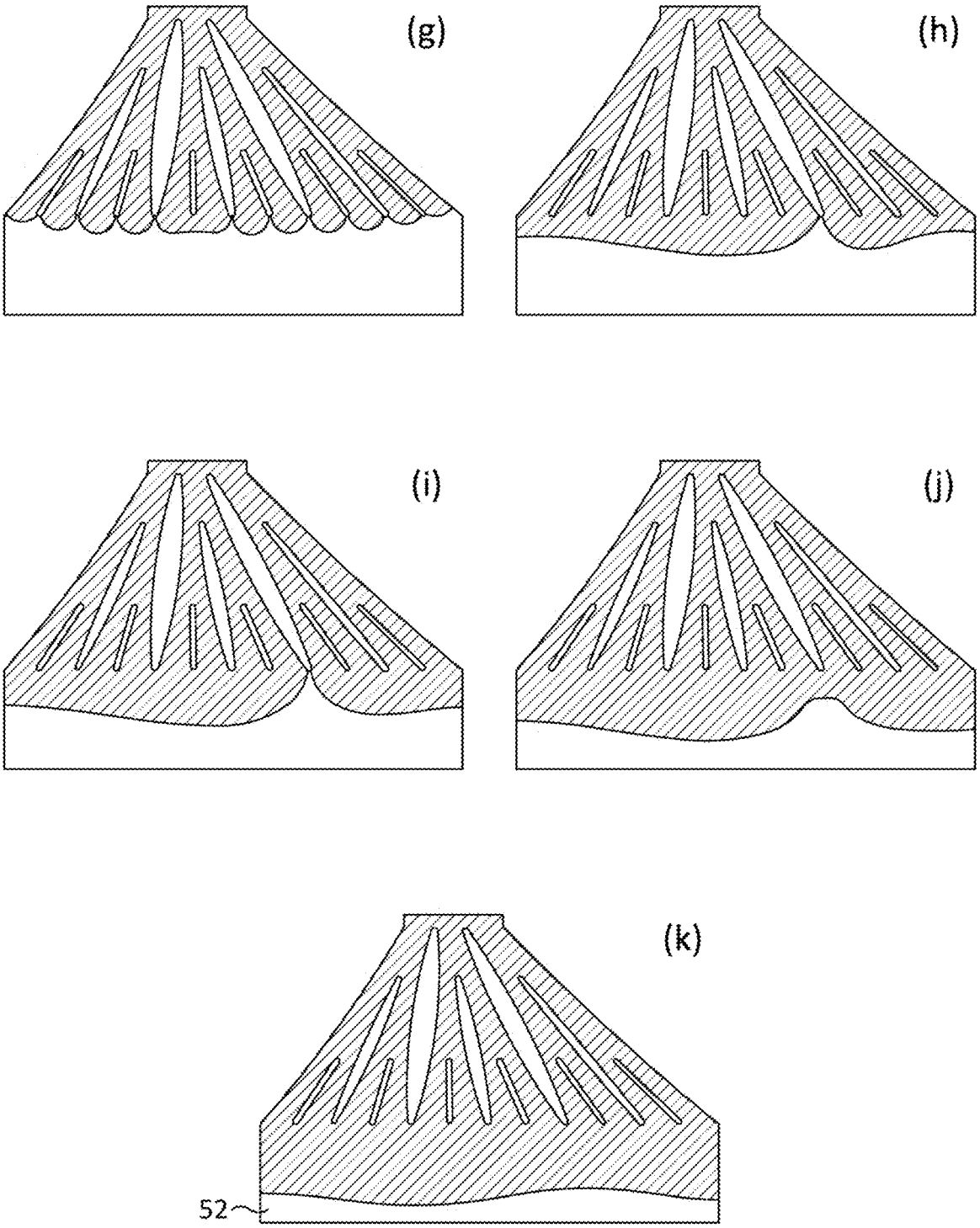

FIG. 7 shows a series of illustrations of computationally-modelled fluid and air positions at a number of time intervals during the priming of a manifold component having an inlet manifold chamber 55 of generally the same construction as that shown in FIG. 3. As before, the computational modelling was performed using standard computational fluid dynamics (CFD) techniques. The inlet manifold chamber depicted in FIG. 7 is similar to that seen in FIG. 3, having a plurality of fluid guides that are so-arranged as to define several hierarchical arrays of fluid passageways.

As can be seen from FIGS. 7(*a*)-(*f*), over time, fluid (hatched regions) introduced into the chamber at its first end travels through the fluid passageways, which divide the fluid flow into a number of sub-flows. As is apparent from FIGS. 7(*g*)-(*k*), the final array of fluid passageways 30(3)(*i-xii*) those closest to the second end 52 of the manifold chamber 55—are configured (e.g. as a result of suitable spacing, alignment and/or shape of the fluid guides that define them) such that these sub-flows then merge to form a combined flow. Subsequent to this merger of all of the sub-flows, the combined flow arrives at the second end 52 of the manifold chamber, i.e. all of the various sub-flows have combined prior to any of the combined flow reaching the second end 52 of the manifold chamber 55.

The inventors consider that configuring the final array of fluid passageways to achieve such a flow pattern may assist in priming the manifold component. Without being bound by any particular theory, the inventors theorize that this is because, as illustrated by FIG. 5B, fluid may in some cases tend to rapidly spread sideways once it has reached the second end of the manifold chamber (which provides the fluidic connection to the actuator component). This rapid sideways spread of fluid may, again as illustrated by FIG. 5B, cause air to be trapped in voids at locations (and particularly corners) that are spaced apart from the second end of the manifold chamber.

It can further be seen from FIG. 7(*g*) that, in the particular embodiment shown, the fluid passageways in the final array 30(3)(*i-xii*) are more particularly configured (e.g. as a result of suitable spacing, alignment and/or shape of the fluid guides that define them) such that the sub-flows emerge at substantially the same time from all of the fluid passageways of the final array 30(3)(*i-xii*). This may, in some cases, further assist with the priming of the manifold component.

It should be understood that the fluid guides in the embodiments of FIGS. 1, 3A, 3B, 4B and 6A could similarly be configured so as to cause the sub-flows from the final array of fluid passageways for each embodiment (e.g. in FIG. 1, fluid passageways 30(*i*)-(*iii*), in FIG. 3A, fluid passageways 30(3)(*i-xii*), in FIG. 3B, fluid passageways 30(3)(*i-xii*), and in FIG. 6A, passageways 30(*i-viii*)) to merge to form a combined flow that, after the completion of such merging, arrives at the second end of the manifold chamber. More particularly, the fluid guides in those embodiments could be configured such that the sub-flows emerge at substantially the same time from all of the fluid passageways of the final array.

A manifold component as described in any of the embodiments herein may be manufactured using 3D printing, as such processes are well-suited to precisely forming internal features such as the fluid guides (and especially slender features, such as the vanes). The precision afforded by 3D printing technique also makes it well-suited to making fluid-tight manifold components.

Nonetheless, manufacture using conventional casting, molding and/or machining techniques may also be envisaged.

In some embodiments, the fluid guides may be provided by internal surfaces of the inlet manifold chamber; other embodiments may utilise fluid guides provided by one or more separate components that are disposed within the manifold chamber.

Furthermore, whether 3D printing or more conventional techniques are used, the manufacturing technique may, for example, additionally comprise assembly of several separately-formed components, and joining them together in any suitable fashion so as to form a single, fluid-tight manifold component, for instance by bonding (e.g. using adhesive), welding, brazing, etc.

It should be understood that manifold components as described herein are suitable for inclusion in a wide variety of droplet ejection heads. In particular, manifold components as described herein are suitable for inclusion in droplet ejection heads having various applications.

In this regard, it should be appreciated that, depending on the particular application, a variety of fluids may be ejected by droplet ejection heads.

For instance, certain heads may be configured to eject ink, for example onto a sheet of paper or card, or other receiving media, such as ceramic tiles or shaped articles (e.g. cans, bottles etc.) Ink droplets may, for example, be deposited so as to form an image, as is the case in inkjet printing applications (where the droplet ejection head may be termed an inkjet printhead or, in particular examples, a drop-on-demand inkjet printhead).

Alternatively, droplet ejection heads may eject droplets of fluid that may be used to build structures. For example, electrically active fluids may be deposited onto receiving media such as a circuit board so as to enable prototyping or manufacture of electrical devices. In examples, polymer containing fluids or molten polymer may be deposited in successive layers so as to produce a 3D object (as in 3D printing). In still other applications, droplet ejection heads might be adapted to deposit droplets of solution containing biological or chemical material onto a receiving medium such as a microassay. Droplet ejection heads suitable for such alternative fluids may be generally similar in construction to inkjet printheads as may the manifold component therein potentially with some adaptations made to handle the specific fluid in question.

Furthermore, it should be noted that droplet ejection heads may be arranged so as to eject droplets onto suitable receiving media, and may therefore be termed droplet deposition heads. For instance, as mentioned above, the receiving media could be sheets of paper or card, ceramic tiles, shaped articles (e.g. cans, bottles etc.), circuit boards, or microassays.

Nonetheless, it is by no means essential that droplet ejection heads as described herein are arranged as droplet deposition heads, ejecting droplets onto receiving media. In some applications, it may be relatively unimportant where the ejected droplets land; for instance, in particular examples droplet ejection heads may be utilised to produce a mist of ejected droplets. Moreover, similar head constructions may, in some cases, be used whether or not the ejected droplets land on receiving media. Accordingly, the more general term "droplet ejection head" is (where appropriate) used in the above disclosure.

Manifold components as described in the above disclosure may be suitable for drop-on-demand inkjet printheads. In such heads, the pattern of droplets ejected varies in dependence upon the input data provided to the head. A droplet ejection head may comprise a manifold component as described in any of the above embodiments and an actuator component 150 fixed at the mount 80.

More generally, it should be noted that other examples and variations are contemplated within the scope of the appended claims. Furthermore, it should be appreciated that the foregoing description is intended to provide a number of non-limiting examples that assist the skilled reader's understanding of the present invention and that demonstrate how the present invention may be implemented.

The invention claimed is:

1. A manifold component for a droplet ejection head, the manifold component comprising:

a mount for receiving at least one actuator component that provides one or more rows of fluid chambers, each chamber being provided with at least one respective actuating element and at least one respective nozzle, each at least one actuating element being actuable to eject a droplet of fluid in an ejection direction through the corresponding at least one of the nozzles, each row extending in a row direction;

an inlet manifold chamber, which extends from a first end to a second end, the second end providing fluidic connection, in parallel, to at least a group of chambers within the one or more rows of fluid chambers and being located adjacent the mount;

at least one inlet port, each inlet port opening into the inlet manifold chamber at the first end thereof; and a plurality of fluid guides disposed within the inlet manifold chamber, each fluid guide extending from a respective first end to a respective second end, the first ends of at least some of the fluid guides being located adjacent the first end of the inlet manifold chamber, and the second ends of at least some of the fluid guides being located adjacent the second end of the inlet manifold chamber;

wherein the fluid guides diverge as they progress from the first end towards the second end of the inlet manifold chamber, the fluid guides thereby causing fluid flowing from the first end to the second end of the inlet manifold chamber to be distributed over the width, in the row direction, of the second end thereof.

2. The manifold component according to claim 1, wherein each fluid guide comprises a respective fluid-directing vane.

3. The manifold component according to claim 1, wherein the fluid guides are provided by internal surfaces of the inlet manifold chamber.

4. The manifold component according to claim 1, wherein the plurality of fluid guides comprises:

a first group of one or more fluid guides, the first and second ends of each of which are located adjacent the first and second ends of the inlet manifold chamber respectively; and a second group of one or more fluid guides, the first end of each of which is spaced apart from the first end of the inlet manifold chamber, and the second end of each of which is located adjacent the second end of the manifold chamber.

5. The manifold component according to claim 1, wherein the plurality of fluid guides comprises a plurality of side-by-side arrays of fluid guides, the arrays of fluid guides being arranged consecutively from the first end to the second end of the inlet manifold chamber, with the number of fluid guides in each array increasing progressively with increasing distance from the first end of the manifold chamber.

6. The manifold component according to claim 1, wherein the fluid guides act to slow the fluid in the centre of the inlet manifold chamber, with respect to the row direction.

7. The manifold component according to claim 1, wherein the fluid guides direct and shape the fluid flow within the inlet manifold chamber such that, on priming, the fluid within may arrive at the second end largely as a flat front.

8. The manifold component according to claim 1, wherein the plurality of fluid guides are configured to direct fluid so as to prevent the formation of void regions where air is trapped as fluid progresses through the manifold component to gradually fill it.

9. The manifold component according to claim 1, wherein the plurality of fluid guides define one or more arrays of side-by-side fluid passageways, with each fluid guide separating neighbouring fluid passageways within at least one such array.

10. The manifold component according to claim 9, wherein the one or more arrays of fluid passageways comprises a final array of fluid passageways, which is proximate the second end of the inlet manifold chamber; and wherein, when a fluid flow enters the inlet manifold chamber, through the at least one inlet port, the fluid flow passes through the final array of fluid passageways after any other of the one or more arrays of fluid passageways, with the fluid flow being divided into respective sub-flows in each of the fluid passageways in the final array.

11. The manifold component according to claim 9, wherein each fluid passageway has a first and a second end, which are nearer, respectively, the first and second ends of the manifold chamber; and wherein respective second ends of the fluid passageways of the final array are aligned with respect to the ejection direction.

12. The manifold component according to claim 10, wherein the sub-flows merge to form a combined flow, which subsequently arrives at the second end of the manifold chamber; and wherein the fluid passageways in the final array are configured such that all of the sub-flows merge into a combined flow, which thereafter arrives at the second end of the manifold chamber.

13. The manifold component according to claim 10, wherein the fluid passageways in the final array are configured such that the sub-flows emerge at substantially the same time from the fluid passageways of the final array.

14. The manifold component according to claim 9, wherein the at least one or more arrays of fluid passageways comprises a plurality of side-by-side arrays of fluid passageways, including an initial array of fluid passageways, which is proximate the first end of the inlet manifold chamber, and a final array of fluid passageways, which is proximate the second end of the inlet manifold chamber, the arrays being arranged consecutively from the first end to the second end of the inlet manifold chamber, with the number of fluid passageways in each array increasing progressively from the initial array to the final array.

15. The manifold component according to claim 9, wherein the width, in the row direction, of each fluid passageway is less than 1/12 of the width, in the row direction, of the second end of the manifold chamber.

16. The manifold component according to claim 1, wherein the plurality of fluid guides define an array of side-by-side fluid passageways, with each fluid guide separating neighbouring fluid passageways within the array, wherein the fluid flow is divided into respective sub-flows in each of the fluid passageways in the array.

17. The manifold component according to claim 16, wherein each fluid passageway has a first end and a second end, which are nearer, respectively, the first and second ends of the manifold chamber; and wherein respective second ends are aligned with respect to the ejection direction.

18. The manifold component according to claim 16, wherein the sub-flows merge to form a combined flow, which subsequently arrives at the second end of the manifold chamber; and wherein the fluid passageways are configured such that all of the sub-flows merge into a combined flow, which thereafter arrives at the second end of the manifold chamber.

19. The manifold component according to claim 17, wherein the fluid passageways in the array are configured such that the sub-flows emerge at substantially the same time from the fluid passageways.

20. A droplet ejection head comprising the manifold component of claim 1, and an actuator component, fixed at the mount.

* * * * *